United States Patent [19]

Rentschler

[11] Patent Number: 4,813,204

[45] Date of Patent: Mar. 21, 1989

[54] ADJUSTABLE DOOR JAMB ASSEMBLY

[75] Inventor: William J. Rentschler, Dothan, Ala.

[73] Assignee: Dunbarton Corporation, Dothan, Ala.

[21] Appl. No.: 142,866

[22] Filed: Jan. 11, 1988

[51] Int. Cl.[4] ..... E06B 1/52; E06B 1/20

[52] U.S. Cl. ..... 52/217; 49/505

[58] Field of Search ..... 52/204, 476, 213, 211, 52/761, 585, 212, 217, 656; 49/505

[56] References Cited

U.S. PATENT DOCUMENTS

| | | | |
|---|---|---|---|
| 2,651,814 | 5/1950 | Lester, Jr. . | |
| 3,420,003 | 5/1967 | Cline . | |
| 3,429,076 | 9/1967 | Fortsch et al. . | |
| 3,808,759 | 5/1974 | Carmichael . | |
| 3,906,671 | 9/1975 | Maldonado . | |
| 4,012,868 | 3/1977 | Andruszkiewicz . | |
| 4,014,146 | 3/1977 | DiMascio et al. . | |
| 4,067,632 | 1/1978 | Sekerich . | |
| 4,128,977 | 12/1978 | Schubeis | 52/217 X |
| 4,246,731 | 1/1981 | Miro | 52/204 |
| 4,395,855 | 8/1983 | Juker | 49/505 X |

FOREIGN PATENT DOCUMENTS

| | | | |
|---|---|---|---|
| 1129253 | 8/1982 | Canada . | |
| 2525588 | 12/1976 | Fed. Rep. of Germany | 52/217 |

*Primary Examiner*—David A. Scherbel
*Assistant Examiner*—Lan Mai
*Attorney, Agent, or Firm*—Jones, Askew & Lunsford

[57] ABSTRACT

An adjustable door jamb assembly which can be simply and accurately aligned and installed in a door opening. Sleeves mounted on door jamb pieces are connected by shafts forming guide units so the door jamb pieces can slide together or apart. The sleeves of the guide units surround the corresponding shafts so as to substantially eliminate play between the door jamb pieces in both the vertical and the horizontal direction parallel to the plane of the door opening. In a preferred embodiment, the sleeves and shafts are cylindrical for greater ease in installation of the door jamb assembly.

24 Claims, 3 Drawing Sheets

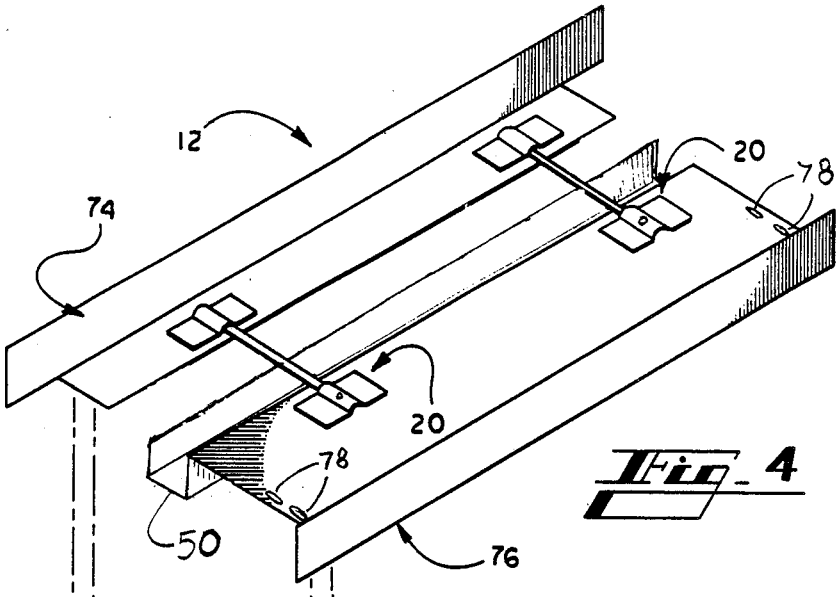
Fig. 4
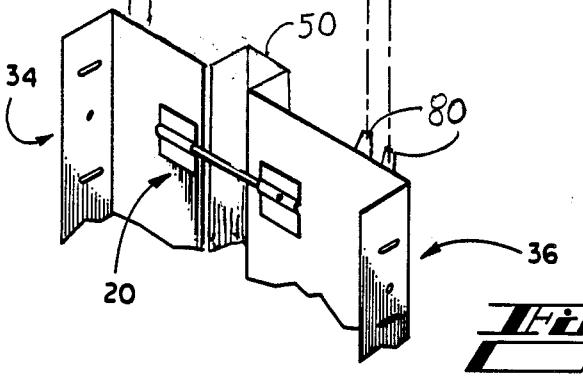
Fig. 5
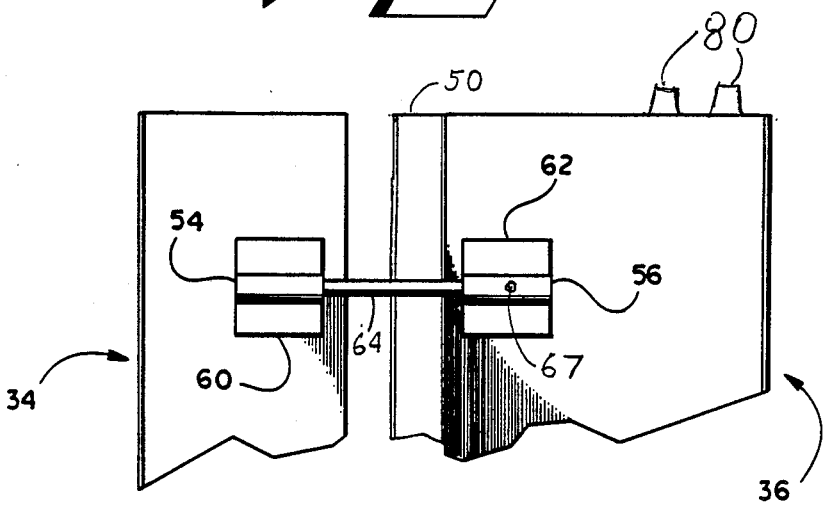

ADJUSTABLE DOOR JAMB ASSEMBLY

TECHNICAL FIELD

The present invention relates in general to prefabricated door jamb assemblies, and, more particularly, relates to adjustable door jamb assemblies that fit a wide variety of widths of door openings.

BACKGROUND OF THE INVENTION

The basic elements of a door jamb are well known. A header jamb frames the top of the door opening, a hinge jamb to which the door is hung frames one side of the door opening, and a strike jamb frames the other side of the door opening. In the past, door jambs were custom made by carpenters at the construction site. This method was time consuming and thus very expensive. Recently, prefabricated door jamb assemblies were developed. Prefabricated door jambs are less expensive to produce and install because they are mass produced, sometimes prefinished, and are quickly installed. Nevertheless, prefabricated door jambs were normally made to fit only certain standard width door openings. Often, door openings did not match the standard door jamb sizes and it became necessary to have door jambs custom made for these door openings.

More recently, adjustable door jamb assemblies have been developed to fit various widths of doorways. Adjustable door jamb assemblies generally include first and second door jamb pieces which are two halves of a door jamb. The two door jamb pieces are placed adjacent one another about the door opening. The two door jamb pieces are then pushed together to fit the width of the door opening.

It is often difficult to align properly the first and second jamb pieces with respect to one another. The two door jamb pieces must be aligned both vertically and horizontally when installed in the door opening. Prior art adjustable door jamb assemblies are often equipped with "guides" to assist in aligning the two door jamb pieces as they are mounted. The prior art guides are generally tongue-and-groove devices. Tongue-and-groove devices are somewhat effective for aligning the two door jamb pieces in either the vertical direction or the horizontal direction but not in both directions at the same time. Nevertheless, a tongue-and-groove device that restricts movement of the two door jamb pieces in the horizontal direction parallel to the plane of the door opening tends to allow some amount of "play" in the vertical direction. Likewise, a tongue-and-groove device that restricts movement in the vertical direction tends to allow some amount of play in the horizontal direction parallel to the plane of the door opening.

Various tongue-and-groove guides for aligning adjustable door jambs have been proposed. One proposal shows a strap with a rectangular channel attached to one-half of the door jamb and a matching converging tongue attached to the other half of the door frame. During assembly of the two halves of the door jamb, the convergent tongue slides into the rectangular channel in the other half of the door jamb. As the tongue slides into the channel, the door jamb halves cannot move relative to one another in the horizontal direction parallel to the plane of the door opening because the vertical sides of the tongue fit tightly against the vertical sides of the channel. However, because the tongue converges in the direction towards the rectangular channel, the top and bottom edges of the tongue do not fit tightly against the top and bottom edges of the channel unless the tongue is fully inserted into the channel. Therefore, such a tongue-and-groove arrangement allows the halves of the door jamb to move vertically as they are being pushed together. As a result, when the door jamb is assembled about a door frame with a width that does not allow the tongue to be fully inserted into the rectangular channel, the halves of the door frame can be misaligned with respect to one another in the vertical direction.

Another proposed guide for aligning the two halves of a door jamb assembly includes two flat rectangular plates each with an identical V-shaped profile along one edge. One plate is attached to one-half of the door jamb and the other plate is attached to the other half of the door jamb so that the V-shaped profiles of the two plates interlock with one another. The interlocking plates provide a guide that restricts the movement of the two door jamb halves in the horizontal direction parallel to the plane of the door opening as the two halves are pushed together. The inner sides of each V-shaped profile holds the vertical walls of the corresponding plate thereby restricting movement in the horizontal direction. However, because the V-shaped profiles are open, they cannot completely restrict movement of the plates and the door jamb halves to which they are connected in the vertical direction, especially when nails are being hammered through the jamb halves to secure the door jamb to the wall. In addition, the V-shaped profile guides are difficult to operate. In order to push the two halves of the door jamb assembly together, the intricate V-shapd profile of the plate attached to one half of the door jamb has to be aligned with the corresponding edge of the plate attached to the other half of the door jamb. This problem is multiplied when several sets of these guides are attached to one door jamb assembly and must be aligned simultaneously.

Therefore, there is a need for a guide for assembling adjustable door jambs that substantially eliminates play between the door jamb pieces in both the vertical direction and in the horizontal direction parallel to the plane of the door opening, and at the same time is quick and simple to operate.

SUMMARY OF THE INVENTION

As will be seen, the present invention solves the above-described problems in the prior art. In general, the present invention comprises a two-piece elongated door jamb, one sleeve mounted on the first door jamb piece and another sleeve mounted on the second door jamb piece so that the two sleeves are proximate to and aligned with each other when the door jamb is assembled. A single shaft fits within the first sleeve and the second sleeve so that the two door jamb pieces can move in relation to one another only along the longitudinal axis of the sleeves. The first and second sleeves surround the shaft restricting movement of the shaft in all directions except axially within the two sleeves.

When the door jamb assembly is installed, the first door jamb piece is placed about one side of the door opening, properly aligned therewith, and then fastened thereto. The shaft is then placed in the first sleeve so that the shaft partially extends from the first sleeve. Next, the second door jamb piece is placed about the other side of the door opening so that the second sleeve is aligned with the shaft in the first sleeve. Then, the second door jamb piece is pushed toward the first door jamb piece along the shaft until the second door jamb piece rests firmly against the wall. The two door jamb pieces are then securely fastened to the wall with nails, screws or the like. Because the movement of the shaft within the two sleeves is restricted in all directions except axially within the sleeves, the second door jamb piece, as it is pushed towards the first door jamb piece does not move with respect to the first door jamb piece in the vertical direction or in the horizontal direction parallel with the plane of the door opening.

Stated somewhat more specifically, the sleeves of the present invention are cylindrical and the shaft is also cylindrical which fits tightly within the sleeves. Because the sleeves and the shaft are both cylindrical, it is not necessary to orient the cross section of the shaft to fit within the cylindrical sleeve. This provides for quick and simple assembly at the construction site. In addition, because the shaft fits tightly within the sleeves, the door jamb pieces are less likely to shift vertically or horizontally parallel with the plane of the door opening during assembly.

Therefore, it is an object of the present invention to provide an adjustable width door jamb assembly with an improved guide device.

It is another object of the present invention to provide an adjustable width door jamb assembly that can be properly aligned when installed in a door opening.

It is another object of the present invention to provide an adjustable width door jamb assembly that can be installed in a door opening with a minimum of vertical play between the door jamb pieces.

It is another object of the present invention to provide an adjustable width door jamb assembly that can be installed in a door opening with a minimum of horizontal play between the door jamb pieces.

It is a further object of the present invention to provide an adjustable width door jamb assembly that is quick and simple to properly align and install in a door opening.

Other objects, features, and advantages will become apparent from reading the following specifications in conjunction with the accompanying drawings.

BRIEF DESCRIPTION OF DRAWINGS

FIG. 4 is a fragmentary pictorial view of the header jamb and the hinge jamb illustrating the manner in which they are assembled; and FIG. 5 is a section view of a guide on the hinge jamb of the disclosed embodiment.

DETAILED DESCRIPTION OF THE DISCLOSED EMBODIMENT

Figure 1:
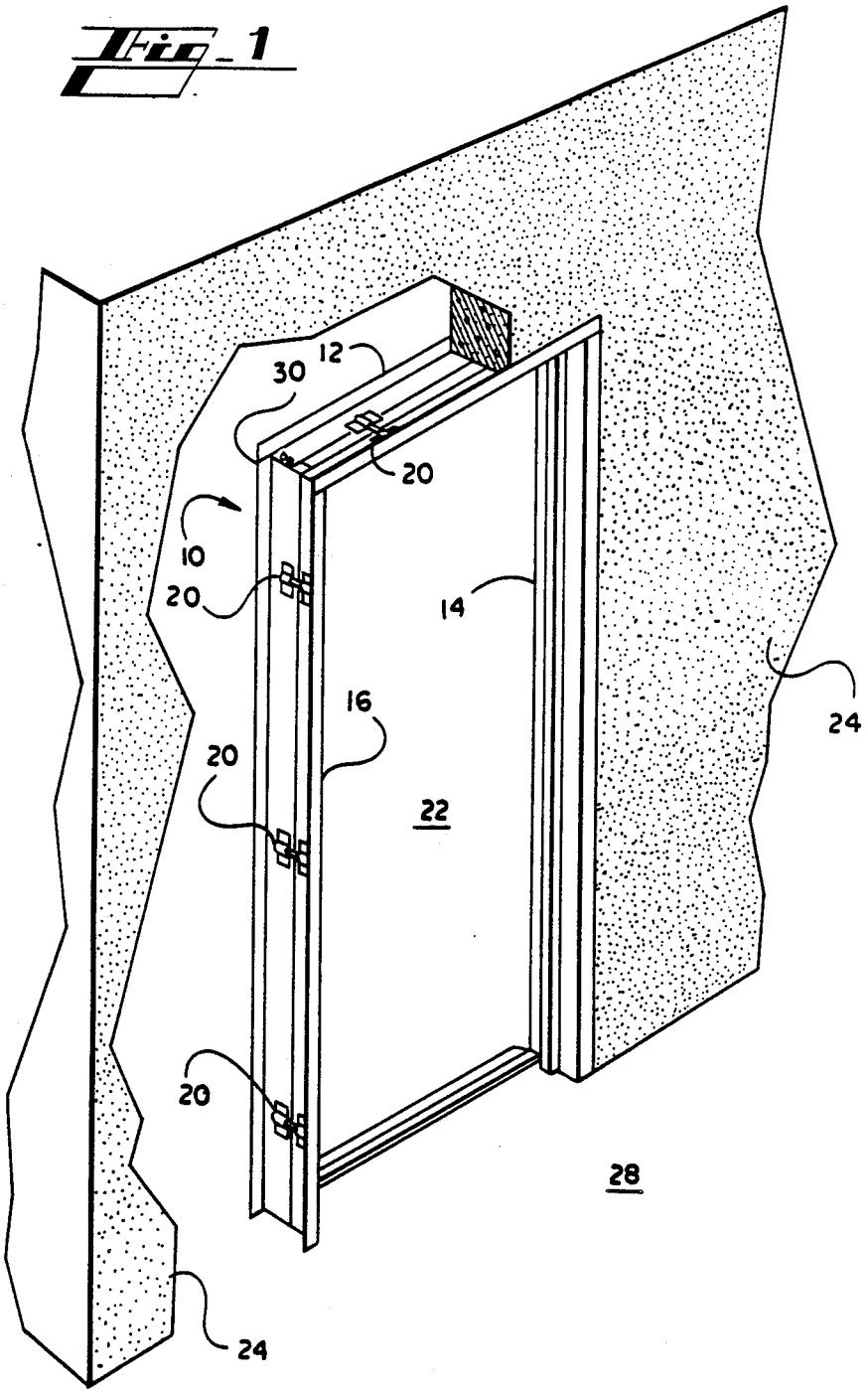
FIG. 1 is a pictorial view of the disclosed embodiment in assembled form.

As best shown in FIG. 1, the adjustable door jamb assembly 10 generally comprises a header jamb 12, a strike jamb 14, a hinge jamb 16, and a plurality of guide units 20. When the door jamb assembly 10 is installed in the door opening 22 in the wall 24, the header jamb 12 is positioned at the top of the door opening. The strike jamb 14 is positioned along one side of the door opening 22 perpendicular to the installed header jamb 12. The strike jamb 14 extends from one end 26 of header jamb 12 to the floor 28. Likewise, the hinge jamb 16 is positioned along the other side of the door opening 22 perpendicular to the header jamb 12. The hinge jamb 16 extends from the other end 30 of the header jamb 12 to the floor 28. The wall 24 is broken away in FIG. 1 to illustrate the positions of three guide units 20 along the hinge jamb 16. The guide units 20 are preferably positioned at intervals along the length of the hinge jamb 16. Other guide units are positioned along the length of both the header jamb 12 and the strike jamb 14, but with the exception of one guide unit shown on the header jamb, the other guide units are hidden from view by the wall 24.

Figure 2:
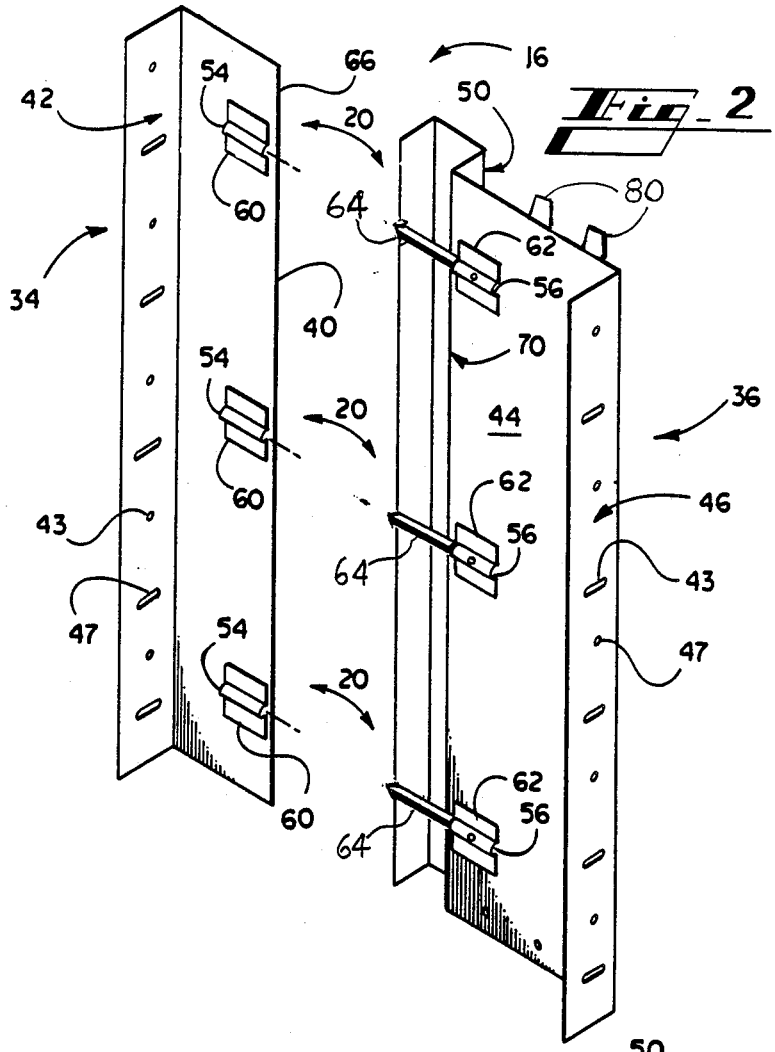
FIG. 2 is a pictorial view of the hinge jamb pieces and accompanying guides.

Turning to FIG. 2, hinge jamb 16 is shown to comprise two longitudinal hinge jamb pieces 34 and 36. The first hinge jamb piece 34 is called a closure strip and the second hinge jamb piece 36 is called a base frame. The hinge closure strip 34 comprises a face plate 40 and a side plate 42 which extends along one side of the face plate perpendicular to the face plate. The hinge base frame 36 also comprises a face plate 44 and a side plate 46 which also extends the length of the face plate perpendicular to the face plate. A rectangular door stop 50 extends along the other side of the hinge base frame face plate 44. The door stop 50 projects from front plate 44 of the hinge base frame 36 towards the interior of the door opening 22. Three guide units 20 connect the hinge jamb pieces 34 and 36.

Figure 3:
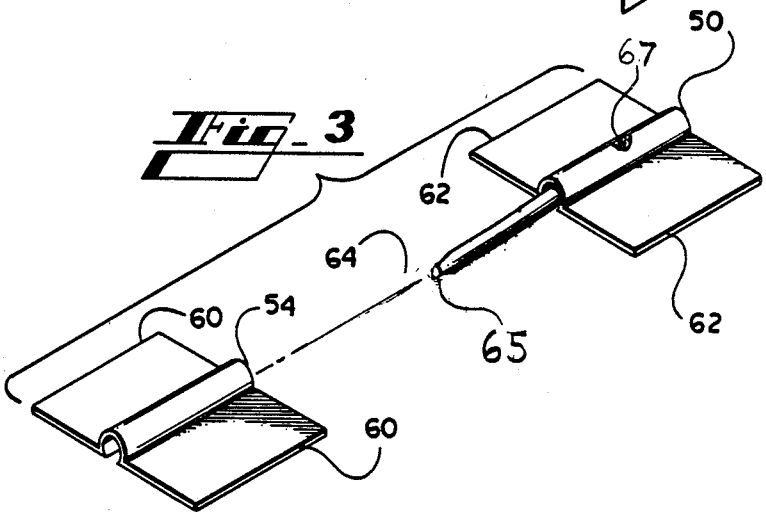
FIG. 3 is a pictorial view of the guide of the disclosed embodiment.

As best shown in FIG. 3, the guide units 20 generally comprise two cylindrical sleeves 54 and 56 mounted on plates 60 and 62 respectively. A cylindrical shaft 64 with a tapered tip 65 fits within the two sleeves 54 and 56 thereby providing a means for the two sleeves 54 and 56 to slide together or apart. It is preferable that the tolerance between the shaft 64 and the sleeves 54 and 56 be substantially 0.005 inches. The cylindrical shaft 64 is preferably secured within sleeve 56 so that a portion of the cylindrical shaft and the tapered tip 65 extend from the sleeve. Nevertheless, it should be understood that the guide unit 20 is operable without securing the shaft 64 within the sleeve 56. The cylindrical shaft 64 is shown to be secured within sleeve 56 with a dimple 67; however, the shaft can be secured by other conventional means such as welding.

Turning back to FIG. 2, it can be seen that one sleeve 54 of each guide unit 20 is positioned adjacent the inner edge 66 of the face plate 50 of the hinge closure strip 34. Likewise, the corresponding second sleeve 56 of each guide unit 20 is positioned adjacent the inner edge 70 of the hinge base frame 36. The sleeves 54 and 56 of each guide unit 20 are positioned on their respective hinge jamb pieces 34 and 36 so that the longitudinal axis of each pair of sleeves are in alignment when the hinge jamb pieces are pushed together.

The strike jamb 14 is identical to the hinge jamb 16 except that the strike jamb 14 is inverted to fit the opposite side of the door opening 22. The strike jamb 14 comprises a strike base frame and a strike closure strip. The header jamb 12 is virtually identical to the hinge jamb 16 except that the header jamb is normally of a shorter length than the hinge jamb. As best shown in FIG. 4, the header jamb 12 comprises two header jamb pieces 74 and 76. The first header jamb piece 74 is a closure strip and the second header jamb piece 76 is a base frame. Slots 78 in the header base frame 76 receive header tabs 80 projecting from the upper edge of the hinge base frame 36 when the door jamb assembly 10 is installed in the door opening 22. Also, guide units 20 are positioned along the header jamb 12 in the same fashion as the guide units on hinge jamb 16.

The header jamb 12, the strike jamb 14, and the hinge jamb 16 are all installed using one or more guides 20. Although it is preferable to use two to three guide units 20 on the header jamb section and three to four guide units on the strike and hinge jamb sections, one to any number of guide units will be effective to align the door jamb pieces as they are installed.

To install the adjustable door jamb assembly 10, the header base frame 76 is mounted onto the hinge base frame 36 and the strike base frame by inserting the header tabs 80 of the hinge base frame and the strike base frame through the slots 78 in the header base frame. The header tabs 80 are then bent over so as to secure the hinge base frame 36 and the strike base frame to the header base frame 76. The assembled base frame is then placed against one side of the wall 24 about the door opening 22 and fastened thereto. The respective closure strips are then placed against the other side of the wall 24 about the door opening 22. The closure strips do not have to be installed in any particular order. The hinge closure strip 34 is positioned parallel and adjacent hinge base frame 36 so that the sleeves 54 and 56 of the guide units 20 are aligned and the tapered tip 65 of the cylindrical shafts 64 enters the opposing sleeves 54. Then, the hinge closure strip 34 is pushed towards the hinge base frame 36 along the shafts 64 (see FIG. 5) until the hinge closure 34 strip rests firmly against the wall 24. In a similar fashion, header closure strip 74 and the strike closure strip are mounted against the wall 24 opposite the header base frame 76 and the strike base frame respectively. Finally, the base frames and the closure strips are firmly secured to the wall 24 with nails, screws, or the like inserted through the slots 43 or the holes 47 in the frames. Because the cylindrical sleeves 54 and 56 surround the tightly fitted shafts 64, the movement of the shaft is restricted in all directions except longitudinally through the sleeves. As a result, hinge jamb pieces 34 and 36 do not move vertically or horizontally parallel to the plane of the door opening as the hinge jamb 16 is installed.

Another advantage of the guide unit 20 is the ease with which the shaft 64 can be inserted within the sleeves 54 and 56. Because the shaft 64 has a cylindrical cross section, the shaft does not have to be specifically oriented in order to fit into the cylindrical sleeves. In addition, the tapered tip 65 of the shafts 64 easily guides the shafts into their respective sleeves 54.

The door jamb assembly 10 preferably comprises metal such as aluminum or steel but it should be understood that the door jamb assembly can comprise wood or plastic as well. It should also be understood that the foregoing relates only to a preferred embodiment of the present invention, and that numerous changes and modifications therein may be made without departing from the spirit and scope of the invention as defined in the following claims:

I claim:

1. A door jamb assembly for framing a door opening comprising:

an elongated door jamb having a first elongated piece and a second elongated piece;

a first sleeve having a first longitudinal axis;

means for mounting the first sleeve on the first door jamb piece;

a second sleeve having a second longitudinal axis;

means for mounting the second sleeve on the second door jamb piece so that the first sleeve is spaced opposite the second sleeve and the second longitudinal axis is substantially aligned with the first longitudinal axis when the door jamb is assembled; and a first shaft slideably engaged and tightly fitting within the first sleeve and the second sleeve so that the first elongated door jamb piece and second elongated door jamb piece can move in relation to one another only along the first longitudinal axis during assembly of the door jamb.

2. The door jamb assembly in claim 1 wherein:

the first sleeve has a cylindrical cross section;

the second sleeve has a cylindrical cross section; and the first shaft has a cylindrical cross section, whereby the first shaft fits within the first sleeve and the second sleeve without particular orientation of the cross section of the first shaft.

3. The door jamb assembly as in claim 2 wherein:

the first shaft has tapered ends.

4. The door jamb assembly as in claim 3 wherein:

the tolerance between the first shaft and the first and second sleeves is substantially 0.005 inches.

5. The door jamb assembly as in claim 1 wherein:

a first portion of the first shaft is secured within one of the first and second sleeves so that a second portion of the first shaft extends therefrom and is slideably engaged within the other of the first and second sleeves.

6. The door jamb assembly as in claim 5, wherein:

the first sleeve has a cylindrical cross section;

the second sleeve has a cylindrical cross section; and the first shaft has a cylindrical cross section, whereby the first shaft fits within the first sleeve and the second sleeve without particular orientation of the cross section of the first shaft.

7. The door jamb assembly as in claim 6, wherein:

the second portion of the first shafts has a tapered end.

8. The door jamb assembly as in claim 7, wherein:

the tolerance between the second portion of the first shaft and the other sleeve is substantially 0.005 inches.

9. The door jamb assembly in claim 1 further comprising:

a third sleeve having a third longitudinal axis;

means for mounting the third sleeve on the first door jamb piece at a location distal from the first sleeve so that the third longitudinal axis is substantially parallel to the first longitudinal axis;

fourth sleeve having a fourth longitudinal axis;

means for mounting the fourth sleeve on the second door jamb piece so that the third sleeve is spaced opposite the fourth sleeve and the fourth longitudinal axis is substantially aligned with the third longitudinal axis when the door jamb is assembled; and a second shaft slideably engaged and tightly fitting within the third sleeve and the fourth sleeve so that the door jamb assembly is more stable and the first elongated door jamb piece and second elongated door jamb piece can move in relation to one another only along the first longitudinal axis during assembly of the door jamb.

10. The door jamb assembly in claim 9 wherein:

the first, second, third and fourth sleeves each have a cylindrical cross section;

the first shaft has a cylindrical cross section; and the second shaft has a cylindrical cross section, whereby the first shaft fits within the first sleeve and the second sleeve without particular orientation of the cross section of the first shaft and the second shaft fits within the third sleeve and the fourth sleeve without particular orientation of the cross section of the second shaft.

11. The door jamb assembly as in claim 10 wherein:
the first and second shafts have tapered ends.

12. The door jamb assembly as in claim 11 wherein;
the tolerance between the first shaft and the first and second sleeves is substantially 0.005 inches; and
the tolerance between the second shaft and the third and fourth sleeves is substantially 0.005 inches.

13. The door jamb assembly as in claim 9 wherein:
a first portion of the first shaft is secured within one of the first and second sleeves so that a second portion of the first shaft extends therefrom and is slideably engaged within the other of the first and second sleeves; and
a first portion of the second shaft is secured within one of the third and fourth sleeves so that a second portion of the second shaft extends therefrom and is slideably engaged within the other of the third and fourth sleeves.

14. The door jamb assembly as in claim 13 wherein:
the first, second, third and fourth sleeves each have a cylindrical cross section;
the first shaft has a cylindrical cross section; and
the second shaft has a cylindrical cross section, whereby the first shaft fits within the first sleeve and the second sleeve without particular orientation of the cross section of the first shaft and the second shaft fits within the third sleeve and the fourth sleeve without particular orientation of the cross section of the second shaft.

15. The door jamb assembly as in claim 14, wherein:
the second portion of the first shaft has a tapered end; and
the second portion of the second shaft has a tapered end.

16. The door jamb assembly as in claim 15, wherein:
the tolerance between the second portion of the first shaft and the other of the first and second sleeves is substantially 0.005 inches; and
the tolerance between the second portion of the second shaft and the other of the second and third sleeves is substantially 0.005 inches.

17. A door jamb assembly for framing a door opening comprising:
an elongated door jamb having a first elongated piece and a second elongated piece;
a plurality of guide units each having a first sleeve, a second sleeve and a shaft;
the first sleeve of each guide unit having a first longitudinal axis;
means for mounting the first sleeve of each guide unit at intervals along the first door jamb piece so that the first longitudinal axes are parallel to one another;
a second sleeve of each guide unit having a second longitudinal axis;
means for mounting the second sleeve of each guide unit at intervals along the second door jamb piece so that the first sleeve of each guide unit is spaced opposite the corresponding second sleeve of each guide unit and the second longitudinal axis of each guide unit is substantially aligned with the corresponding first longitudinal axis of each guide unit when the door jamb is assembled; and
the shaft of each guide unit slideably engaged and tightly fitting within the corresponding first sleeve and the corresponding second sleeve so that the first elongated door jamb piece and second elongated door jamb piece can move in relation to one another only along the first longitudinal axis during assembly of the door jamb.

18. The door jamb assembly in claim 17 wherein:
the first sleeve of each guide unit has a cylindrical cross section;
the second sleeve of each guide unit has a cylindrical cross section; and
the shaft of each guide unit has a cylindrical cross section, whereby the shaft of each guide unit fits within the corresponding first sleeve and the corresponding second sleeve of each guide unit without particular orientation of the cross section of the shaft of each guide unit.

19. The door jamb assembly as in claim 18, wherein:
the shaft of each guide unit has tapered ends.

20. The door jamb assembly as in claim 19, wherein:
the tolerance between the shaft of each guide unit and the and second sleeves of each guide unit is substantially 0.005 inches.

21. The door jamb assembly as in claim 17, wherein:
a first portion of the shaft of each guide unit is secured within one of the first and second sleeves of each guide unit so that a second portion of the shaft of each guide unit extends therefrom and is slideably engaged within the other of the first and second sleeves of each guide unit.

22. The door jamb assembly as in claim 21, wherein:
the first sleeve of each guide unit has a cylindrical cross section;
the second sleeve of each guide unit has a cylindrical cross section; and
the shaft of each guide unit has a cylindrical cross section, whereby the shaft of each guide unit fits within the corresponding first sleeve and the corresponding second sleeve of each guide unit without particular orientation of the cross section of the shaft of each guide unit.

23. The door jamb assembly as in claim 22, wherein:
the second portion of the shaft of each guide unit has a tapered end.

24. The door jamb assembly as in claim 23, wherein:
the tolerance between the second portion of the shaft of each guide unit and the other of the first and second sleeves of each guide unit is substantially 0.005 inches.

* * * * *